US006481136B1

(12) United States Patent
Fitzpartick

(10) Patent No.: US 6,481,136 B1
(45) Date of Patent: Nov. 19, 2002

(54) INTEGRAL MAGAZINE EXTRACTION EXTENSIONS

(76) Inventor: Richard Mark Fitzpartick, 1109 Par Road, Broomfield, CO (US) 80020

( * ) Notice: Subject to any disclaimer, the term of this patent is extended or adjusted under 35 U.S.C. 154(b) by 0 days.

(21) Appl. No.: 09/504,646

(22) Filed: Feb. 14, 2000

(51) Int. Cl.[7] ..... F41A 9/65
(52) U.S. Cl. ..... 42/50; 42/18
(58) Field of Search ..... 42/7, 49.01, 50, 42/18, 22

(56) References Cited

U.S. PATENT DOCUMENTS

| | | | | | |
|---|---|---|---|---|---|
| D33,384 | S | | 10/1900 | Thorn | |
| 812,016 | A | * | 2/1906 | Bye | 42/18 |
| 888,560 | A | * | 5/1908 | White | 42/50 |
| 1,245,499 | A | * | 11/1917 | Orme | 42/50 |
| 1,596,076 | A | | 8/1926 | Clancy | |
| 1,797,951 | A | | 3/1931 | Gaidos | |
| 2,205,967 | A | * | 6/1940 | Wise | 42/49.01 |
| 2,825,991 | A | | 3/1958 | Stadelmann | |
| 3,000,527 | A | | 9/1961 | Jennings | |
| 3,191,332 | A | * | 6/1965 | Ardolino | 42/50 |
| 3,803,739 | A | * | 4/1974 | Haines et al. | 42/50 |
| 4,397,109 | A | * | 8/1983 | Pachmayr et al. | 42/50 |
| 4,442,962 | A | | 4/1984 | Musgrave | |
| 4,592,160 | A | * | 6/1986 | Bross | 42/7 |
| 4,796,937 | A | | 1/1989 | Andrea | |
| 5,526,600 | A | * | 6/1996 | Chesnut et al. | 42/50 |
| 5,566,487 | A | * | 10/1996 | Vaid et al. | 42/7 |
| 5,906,065 | A | * | 5/1999 | Pearce | 42/7 |
| 6,212,815 | B1 | | 4/2001 | Fitzpatrick | |

FOREIGN PATENT DOCUMENTS

| | | | | |
|---|---|---|---|---|
| AU | 58306 | * | 3/1913 | 42/7 |
| GB | 9490 | * | 6/1896 | 42/7 |
| GB | 9490 | * | 4/1898 | 42/7 |
| GB | 3220 | * | 1/1908 | 42/7 |

OTHER PUBLICATIONS

Pierce Grip, advertisement, Shooting Industry, Nov. 1998 p. 21, v. 43, No. 11, Publishers Development Corp., San Diego, CA, USA.

* cited by examiner

*Primary Examiner*—Stephen M. Johnson
(74) *Attorney, Agent, or Firm*—Geoffrey E. Dobbin

(57) ABSTRACT

Integral extensions to aid in the extraction of ammunition magazines from ammunition pouches are provided in three embodiments. A method for modifying existing magazine floor plates to receive integral handle extensions is also provided. In one embodiment, a substitute floor plate is molded with a handle projecting from its outer face. In a second embodiment, a handle with a grip and a terminal end is provided with an attachment structure on the terminal end. Floor plates are then either modified by cutting anchoring holes to allow for the attachment of such handles without hindering use in an ammunition magazine or molded with said anchoring holes. In a third embodiment, the sides of an ammunition magazine are extended, either by molding or affixing a handle directly to the sides of the magazine, to provide a handle.

9 Claims, 4 Drawing Sheets

INTEGRAL MAGAZINE EXTRACTION EXTENSIONS

FIELD OF INVENTION

The present invention relates to the fashioning of extensions on ammunition magazines and more particularly to pull-tab and loop handle extensions that are positioned on the floor end of ammunition magazines by either replacing the floor plate, modifying the floor plate or extending the side magazine walls in order to aid with both the extraction of said ammunition magazine from ammunition pouches and the insertion into a weapon.

BACKGROUND OF THE INVENTION

The use of loops to aid in the removal of ammunition magazines from a storage compartment is known in the prior art. Likewise, the use of handle attachments or tabs or other extensions to carry ammunition magazines and other objects is also known. These attachments and modifications, while suitable for their individual purposes, are not as suitable for the purpose of this invention, namely providing an extension that is of one piece with an ammunition magazine or with the floor plate of said magazine for the purpose of extraction of said magazine from ammunition pouches worn on the user. For example, the current practice of forming duct tape tabs and cord loops on ammunition magazines; magazine grips by Magpul Industries Corporation; GLOCK grip enhancers by PIERCE GRIP; U.S. Pat. No. 4,796,937 to Andrea; U.S. Pat. No. 4,442,962 to Musgrave; U.S. Pat. No. 3,000,527 to Jennings, et al.; U.S. Pat. No. 2,825,991 to Stadelmann; U.S. Pat. No. 2,205,967 to Wise; U.S. Pat. No. 1,797,951 to Gaidos; U.S. Pat. No. 1,596,076 to Clancy; U.S. Pat. No. 1,245,499 to Orme And U.S. Pat. No. D-33,384 to Thorn are all illustrative of the prior art.

CURRENT PRACTICE

FORMING DUCT TAPE TABS AND CORD LOOPS

NO PATENT NUMBER

Currently, in the field, soldiers use either loops of parachute cord attached to ammunition magazines by duct tape or they form tabs by folding duct tape over the butt end of their ammunition magazines. The loops and tabs aid soldiers in the extraction of said magazines from ammunition pouches carried on the user. However, the duct tape tends to wear and often needs replaced. The duct tape also leaves a sticky residue when removed and provides no other benefit other than the increased friction or fastening a pull loop to the ammunition magazine. Soldiers have also extracted the inside portion of a length of parachute cord, leaving the casing, tied said casing together and positioned the formed loop so that it encircles the floor plate of an ammunition magazine before they replaced said floor plate, with the loop, in the magazine. Thus they have formed a loop, extending from the bottom of the magazine.

MAGPUL INDUSTRIES CORPORATION

MAGAZINE GRIPS

U.S. APPLICATION SERIAL NUMBER 09/293,403

INVENTOR: Richard M. Fitzpatrick

Magazine grips are thermoplastic sleeve and handle combinations which fit on the floor end of ammunition magazines. When the handle is pulled, the sleeve grips the magazine and enables the user to extract the ammunition magazine from an ammunition pouch. The handle may take any shape, though loops and tabs are most common.

PIERCE GRIP

GRIP ENHANCERS

U.S. PATENTS PENDING

PIERCE GRIP provides grip enhancers for GLOCK brand handguns. These grip enhancers replace the floor plate of GLOCK handgun magazines and are thicker than said floor plates, thus providing, with the handle, a larger gripping surface than with the standard floor plate and handle. They are often color coded to reflect the type of ammunition used in a particular magazine.

ANDREA, DOUGLAS J

INSULATING SHELL AND POURING AID FOR CONTAINER AND METHOD FOR MAKING THE SAME

U.S. Pat. No. 4,796,937

An insulating shell and carrier for a bottle in which the shell is formed of an insulating material. The shell has a main body section, with an opening into which the bottle fits, and an integral handle. The handle is a loop that the user may grasp to hold the bottle while pouring the liquid or may otherwise use to carry the bottle. The shell is preferably made out of a flat sheet of material, cut to the desired shape and size and joined at the edges to form a configuration matching the bottle.

MUSGRAVE, DANIEL D

MAGAZINE HANGER

U.S. Pat. No. 4,442,962

A cartridge magazine hanger adapted for quick removal of a magazine therefrom using only one hand. The magazine is supported by engagement of at least one of its feed lips with a support on the hanger. The hanger is equipped with loops that may be used to attach the hanger to any structure, vehicle, a person's clothing or even the weapon itself The hanger also covers the feed mouth of the magazine to protect the ammunition from damage and prevent the entry of extraneous matter into the magazine.

JENNINGS, W. C, ET AL

HANDLE FOR CONTAINERS

U.S. Pat. No. 3,000,527

This invention is a handle for containers, particularly glass milk containers. The handle is made of an elastomeric material comprising a band and finger grip potions. When warmed, the band portion slips over the rim of a glass milk container. When cooled, the band portion of the handle is not elastic enough to allow the container rim to slip out, thus allowing the user to carry the container using the finger grip portion of the handle.

STADELMANN, RUDOLF

MAGAZINE ARRANGEMENT FOR MEDIUM CALIBRE GUNS

U.S. Pat. No. 2,825,991

This arrangement is for medium caliber guns (20–40 mm caliber). The arrangement is essentially a box with one side open to allow for loading ammunition into the magazine. The top of this arrangement features a detachable metal loop to allow the user to extract the arrangement from an ammunition chest.

WISE, CHARLES REX

RIFLE MAGAZINE

U.S. Pat. No. 2,205,967

Magazine designed to increase capacity of a rifle and relating the ammunition in a manner that automatically feeds ammunition through the rifle. A loop is provided on the butt and of the magazine so that it may be attached to the user's clothing or other device.

GAIDOS, ALONZO F

FIREARMS MAGAZINE

U.S. Pat. No. 1,797,951

Magazine designed to expedite reloading when the magazine is empty. To this end, the magazine uses a retractable sliding plate to allow access to the interior of the magazine and to depress the follower plate, allowing ammunition to be loaded into the magazine. Attached to the sliding plate is a metal finger loop, allowing the user to pull the sliding and follower plates down.

CLANCY, KENNETH A

BOTTLE CARRIER

U.S. Pat. No. 1,596,076

This bottle carrier is a single elongated strip of flexible material designed to accommodate assorted sizes of bottles. The strip accomplishes its purpose by means of two longitudinally extending slits cut in the strip. Using these slits, the strip may be looped around the neck of the bottle, under the rim. The free ends are then threaded through the slits and brought together to form a carrying loop.

ORME, GARDNER P

FIREARM MAGAZINE

U.S. Pat. No. 1,245,499

This magazine is designed to aid in the compression of the follower spring and, thus, aid in reloading the magazine. The invention is a magazine with its side designed to accommodate the insertion of a pin. The pin is then used to compress the follower spring by simply squeezing the user's fingers, which are placed over the pin, towards the user's thumb, placed on the underside of the magazine. A loop, which is not necessary for the invention, is nonetheless displayed in the drawings of this invention on the butt end of the magazine. Due to its size relative to the magazine, it can be presumed to be used for standard attachment purposes.

THORN, OLIVER

GUN-CARRYING ATTACHMENT FOR CYCLES

U.S. Pat. No. D-33,384

This simple design comprises of two bands of material. One forms an ellipse and the other forms a carrying loop with its ends attached to the elongated sides of the ellipse. The gun is presumably held in place by a small curved member placed on the ellipse.

While the aforementioned inventions accomplish their individual objectives, they do not describe an integral extension that is used primarily for the extraction of ammunition magazines from ammunition pouches, as evidenced by the duct tape modifications used in the field. Handle and loop attachments used in the prior art are mainly used for affixing an ammunition magazine to other objects, such as clothing or vehicles, or to carry bottles. In one of the two cases where handle attachments are used for extraction, the handle is a simple metal wire forming a loop and is not adapted for use in the various positions a user may wear an ammunition pouch. There are also disadvantages with the duct tape modifications, particularly regarding removal and in the amount of slack in a loop of parachute cord. While the PIERCE GRIP grip enhancer discloses replacement of the floor plate, the enhancer is designed for improving the grip a user has on his gun, not the ammunition magazine, and does not disclose any type of handle extension. Magazine grips, by Magpul Industries Corporation, disclose a handle which is attached to an external sleeve, not an integral handle. In this respect, the extensions according to the present invention depart substantially from the usual designs in the prior art. In doing so, this invention provides integral extensions that are primarily designed for the purpose of aiding the extraction of ammunition magazines from pouches worn on the user.

SUMMARY OF THE INVENTION

In view of the foregoing disadvantages inherent in the known types of attachments and grip extensions, this invention provides extensions for use on the base of ammunition magazines. As such, the present invention's general purpose is to provide a new and improved integral extensions that will aid in the extraction of ammunition magazines from pouches worn on the user.

To attain this, the invention has three individual embodiments. The first embodiment essentially comprises a replacement floor plate, typically molded of a hard plastic or metal, with a tab or loop extending from the replacement floor plate, typically molded from a more resilient plastic or thermoplastic compound. The product would be manufactured by using a bifurcated molding process where the floor plate portion would be molded first and the extension would be molded onto the floor plate in a second molding step. Alternatively, the floor plate may be molded or fashioned with at least one anchoring hole and the handle then either injection molded onto the floor plate or pre-molded with at least one anchoring means and mechanically coupled to the floor plate. The second embodiment would require retrofitting all existing floor plates with at least one anchoring hole along the center of their elongated sides or boring a plurality of holes through a floor plate and either injection molding or mechanically coupling a handle onto the floor plate. In the third embodiment, a plastic magazine would be molded with a resilient loop or tab on its base end or a handle may be attached to the base end by mechanical, ultrasonic welding, or adhesive means.

These designs have numerous advantages over the prior art. First, the extensions are integral with the magazine and have a lower incidence of grip failure. Second, the first two embodiments are easily replaceable if and when necessary. Third, the standard means of ejection causes the butt end of the magazine to impact the ground. The molded handle portion acts as a shock absorber for the magazine when it is ejected from the rifle and reduces impact damage to the magazine. Fourth, the extensions abut against the lid of the pouch. This abutment effectively anchors the magazine against the pouch lid and reduces noise caused by the rattling of magazines against pouch when the user is moving.

The more important features of the invention have thus been outlined in order that the more detailed description that follows may be better understood and in order that the present contribution to the art may better be appreciated. Additional features of the invention will be described hereinafter and will form the subject matter of the claims that follow.

The primary object of the present invention is to provide integral extensions for use on ammunition magazines to aid in their extraction from ammunition pouches.

It is another object of the invention to provide extensions that will accommodate users by being adaptable to individual styles of extraction, locations of the pouch on the user, and location of the rifle's ammunition chamber.

It is an additional object of the invention to provide extensions that are easily removed for replacement.

It is yet another object of the invention to provide extensions that will absorb some of the shock of impact when an ammunition magazine is ejected from a rifle.

It is a further object of the invention to provide extensions that will deaden noise caused by rattling of ammunition magazines in the ammunition pouch It is a still further object of the invention to provide extensions, the manufacture of which is readily adaptable to create such attachments for different sizes and calibers of hand held weapons.

It is an even further object of the invention to provide extensions that are adaptable towards the thickness of a user's fingers or use of gloves.

Lastly, it is an object of the invention to provide extensions that are easy and economical to manufacture so as to keep cost to the consuming public reasonable.

Other objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
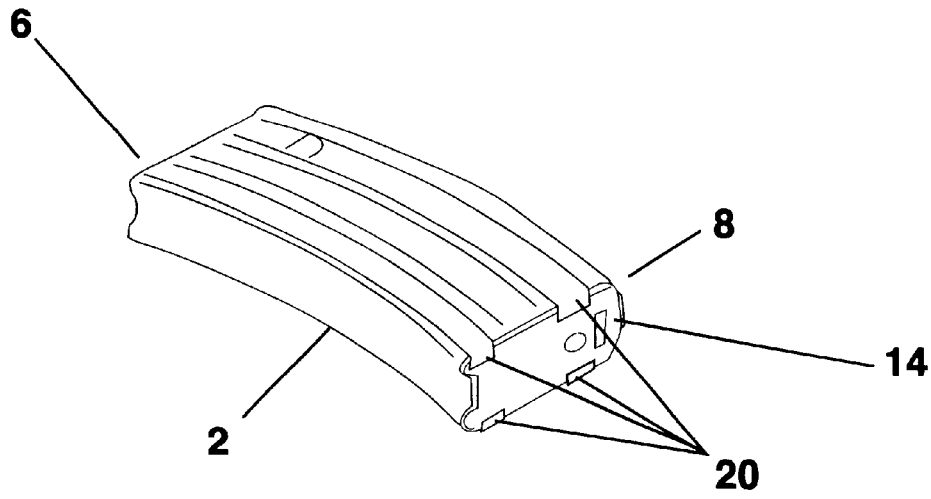
FIG. 1 is a perspective view of a standard M-16 magazine.
Figure 2:
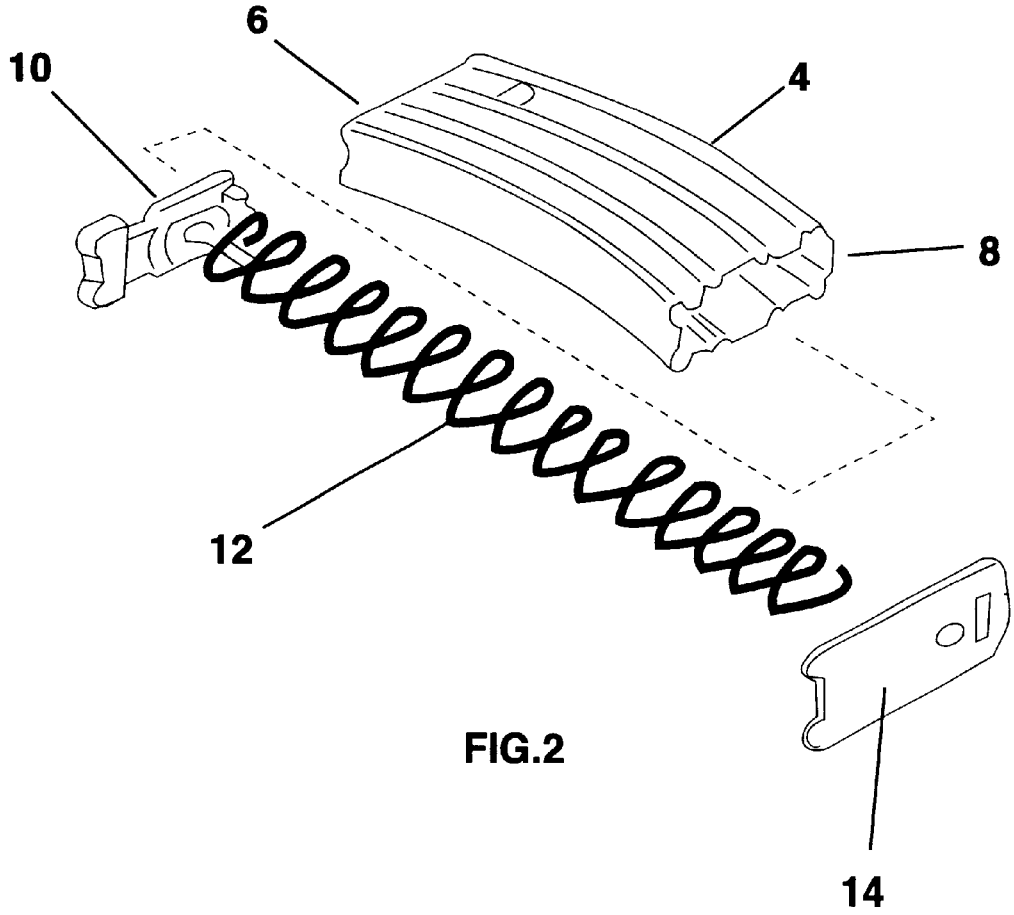
FIG. 2 is an exploded view of the magazine in FIG. 1.
Figure 17:
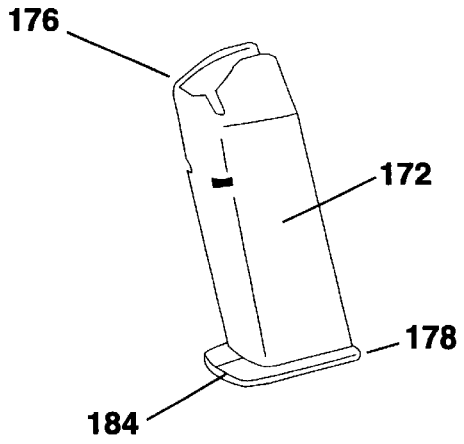
FIG. 17 is a perspective view of a handgun magazine with a sliding floor plate.
Figure 17A:
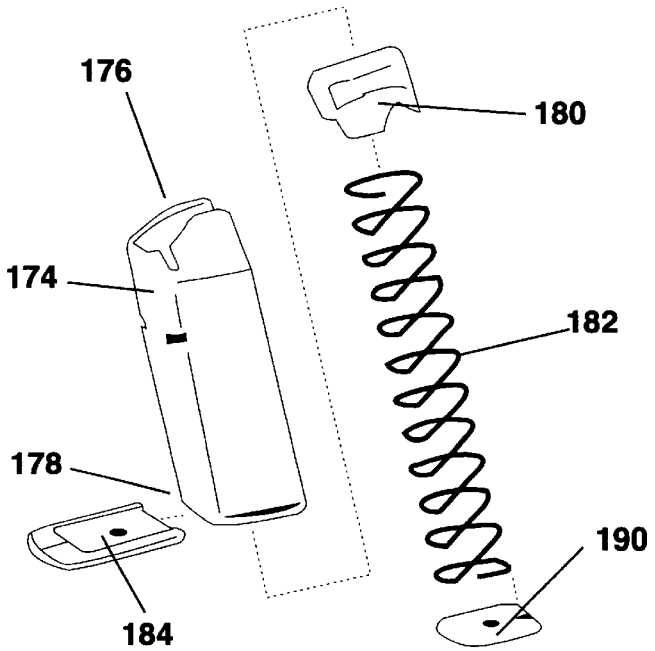
FIG. 17*a* is an exploded view of the magazine in FIG. 17.
Figure 17B:
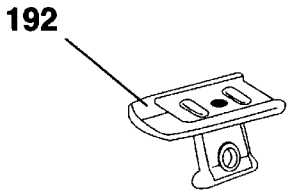
FIG. 17*b* is a perspective view of a modified floor plate for the magazine in FIG. 17.
Figure 17C:
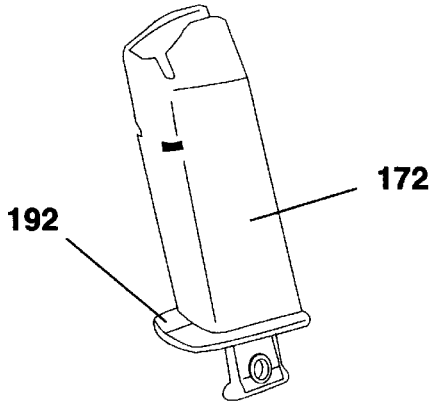
FIG. 17*c* is a perspective view of the magazine in FIG. 17 with the floor plate of FIG. 17*b* installed.

With reference now to the drawings, the preferred embodiment of the new and improved integral extensions for ammunition magazines embodying the principles and concepts of the present invention will be described. Specifically, it will be noted in the figures, especially FIGS. 5, 6, and 9, that the invention relates to the addition of extensions to the floor plate of ammunition magazines and to the addition of similar extensions to the elongated walls of plastic ammunition magazines. Before the invention can be explained, a brief description of the structure of an ammunition magazine, shown in FIGS. 1 and 2, is necessary. The generic magazine 2 is a relatively simple structure. The outer casing 4 is suitably sized and shaped to receive ammunition. The casing 4 has a feed end 6 and a floor, or butt, end 8. The feed end 6 is designed to engage the weapon. Inside the casing, a follower plate 10 is in contact with the follower spring 12, which is in turn, in contact with the floor plate 14. When ammunition is loaded into the feed end 6, the follower plate 10 compresses the follower spring 12 against the floor plate 14. This compression is relaxed when a round of ammunition is loaded into the weapon's firing chamber and the spring 12 therefore raises the follower plate 10, and associated ammunition relative to the magazine 2 and weapon. The raising readies the next round of ammunition for loading into the weapon's firing chamber after the first round is used and expelled. Referring to FIGS. 17 and 17*a*, a similar construction for handgun magazines is shown, including casing 174, feed end 176, floor end 178, follower plate 180, follower spring 182, floor plate 184 and locking plate 190.

Figure 4:
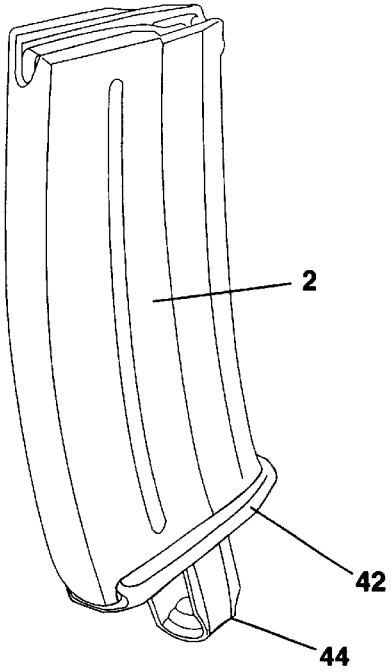
FIG. 4 is a perspective view of a magazine with a sliding type floor plate with the invention installed.
Figure 3:
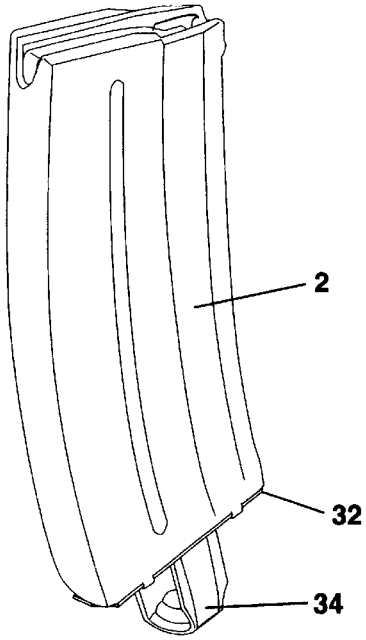
FIG. 3 is a perspective view of the magazine of FIG. 1 with the invention installed.
Figure 8:
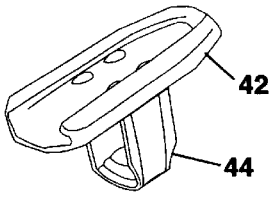
FIG. 8 is a perspective view, as seen from the bottom, of the invention as a sliding replacement floor plate with a loop design.
Figure 7:
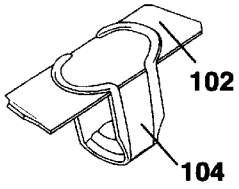
FIG. 7 is a perspective view, as seen from the bottom, of the invention as a retrofitted floor plate with a loop design.
Figure 6:
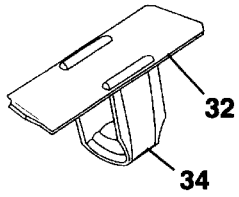
FIG. 6 is a perspective view, as seen from the bottom, of the invention as a standard replacement floor plate with a loop design.
Figure 5:
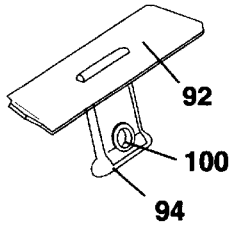
FIG. 5 is a perspective view, as seen from the bottom, of the invention as a standard replacement floor plate with a tab design.

The first embodiment of the invention, shown in FIGS. 3 and 4, is a substitute floor plate 32, 42 positioned on the floor end of an ammunition magazine. The floor plate 32, 42 is ideally molded from a rigid plastic or metal, with a handle 34, 44 protruding from said substitute floor plate 32, 42. The handle 34, 44 can be molded onto the substitute floor plate 32, 42 by using a bifurcated molding process where the floor plate 32, 42 is molded from a rigid plastic and the handle 34, 44 is ideally molded from a softer, more resilient material, such as thermoplastic, and attached to the substitute floor plate 32, 42. The two staged molding process may include either molding the handle 34, 44 directly onto the floor plate 32, 42, so that the handle 34, 44 and floor plate 32, 42 are of one piece, or molding the floor plate 32, 42 with a plurality of holes and then the handle 34, 44 may be injection molded, onto the floor plate 32, 42, shown in FIGS. 5, 6 and 8. Alternatively, The handle 34, 44 may be molded separately, shown in FIGS. 10 and 12, having a grip end 31, 41 and a fastening end 33, 43. The fastening end should have at least one terminus 35, 45, each with at least one anchoring means, such as the anchoring nodes 38, 48 shown in FIGS. 10 and 12, and then mechanically coupled to the floor plate 32, 42. The handle may take any shape, such as a loop 34, as shown in FIG. 6, or a tab 94, as shown in FIG. 5. The loop and the tab are both preferable, depending on the user's preferences and the design of the magazine. A user may find the tab version of FIG. 5 preferable when using the generic magazine shown in FIGS. 1 and 2, where the floor plate 14 is secured with a plurality of tabs 20. A loop may interfere with the tabs 20 and hinder installation. Other magazine designs have a sliding and locking floor plate 42, as shown in FIG. 4, and therefore would not have the hindrance of tabs. For these designs, either the tab version of FIG. 5 or the loop version of FIG. 6 could be used.

Figure 12:
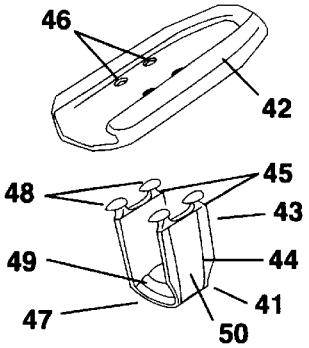
FIG. 12 is an exploded view of the invention as seen in FIG. 8.
Figure 10:
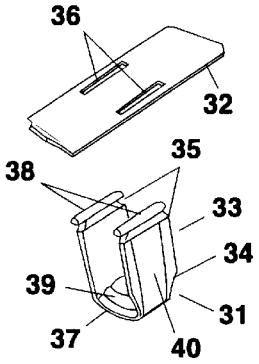
FIG. 10 is an exploded view of the invention as seen in FIG. 6.

Either handle 34 or 94 should extend approximately 1.0 to 1.5 inches from the substitute floor plate 32, 92. This will enable the handle 34, 94 to engage the lid of an ammunition pouch. With the loop handle version, see FIG. 10, the loop 34 should have a height of about 1.0 to 1.5 inches and a width varying from 1.0 to 0.5 inch. The loop 34 is thicker at its apex 37 so as to better withstand the stress of pulling the invention and the magazine out of the ammunition pouch by the loop 34. The width of loop 34 at apex 37 is less than the rest of loop 34 so that a user's finger may curl around loop 34. For ease of fabrication and to increase friction between a finger and the loop 34, the underside of the apex 37 may be molded in a step-like pattern 39, as shown in FIGS. 10 and 12. The tab 94 in FIG. 9 may be molded with a variety of shapes, including but not limited to ovals, cylinders, knobs, and wedges. No limitation as to shape should be inferred from the drawings. For this variation, a small reinforced hole 100 should be provided in the tab 94 so that a user may hook the magazine onto a carabineer after ammunition is spent. In both variations, roughened recessed areas 40, 99 should be provided. In the loop version of FIGS. 10 and 12, recessed areas 40, 50 extend along the length of loops 34, 44. In the tab version shown in FIG. 9, any recessed areas would be determined by the shape of tab 94. For the version of the tab shown in FIG. 9, recessed areas 99 are provided on the planar faces of the tab 94. Also, the top of the tab 94 is molded with a ridge 97 to facilitate gripping the tab 94.

Figure 11:
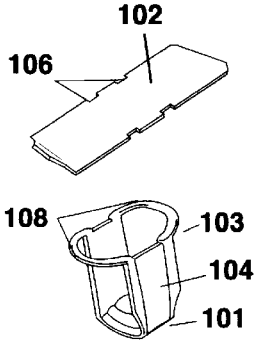
FIG. 11 is an exploded view of the invention as seen in FIG. 7.
Figure 9:
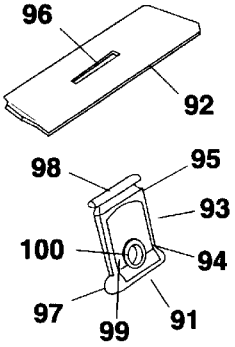
FIG. 9 is an exploded view of the invention, as seen in FIG. 5.

In the second, retrofitting, embodiment, shown in FIGS. 9, 10, 11 and 12 the floor plate 32, 42 is modified to accommodate the attachment of a handle 34, 44. Small holes 36, 46, similar to those molded into the substitute floor plate 32, 44 of the previous embodiment, as shown in FIGS. 9, 10, and 12 may be bored into a floor plate 32, 42 and a handle 34, 44 either injection molded or mechanically coupled onto the modified floor plate as in the previous embodiment. As shown in FIG. 11, holes 106 may be positioned along the sides of the floor plate 102, thus forming notches along the floor plate's elongated ends and a handle 104 having a grip end 101 and a fastening end 103 is fastened to the floor plate 102. An attachment means 108 is located at the handle's fastening end 103 fits around the floor plate 102 at the notches 106. The attachment means 108 may either be a continuous bracing loop, a plurality of tabs or a plurality of continuous bracing loops, as shown in FIG. 11, that are threaded around the notches 106. The attachment means may be affixed to the floor plate 102 with some type of adhesive, such as epoxy or glue, or ultrasonically welded, assuming the floor plate 32, 42 and handle 34, 44 are plastic. The attachment structure should be thin enough to not interfere with the normal operation of the ammunition magazine, that is to say not interfere with the follower spring 12 of FIG. 2 or the locking plate 190 of FIG. 17*a*, but thick enough to withstand repeated use, usually ¼ inch to ¾ inch.

Figure 13:
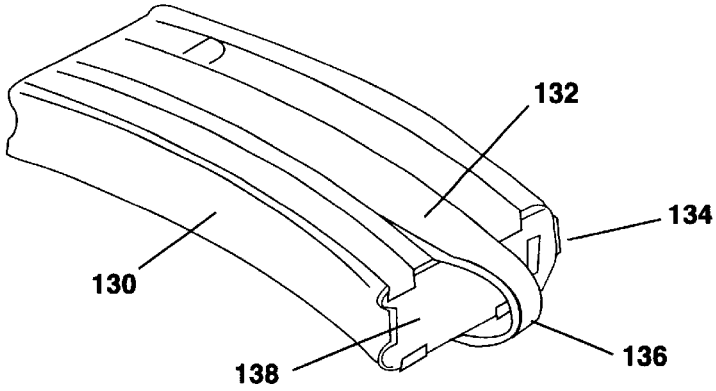
FIG. 13 is a perspective view of the invention detailing the side extension embodiment
Figure 14:
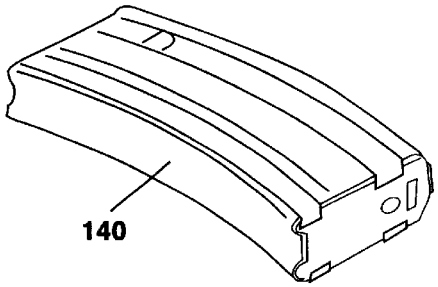
FIG. 14 is an exploded view of the adhesive embodiment of the invention.
Figure 14A:
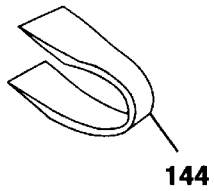
FIG. 14*a* is a perspective view of the invention in FIG. 14 assembled.
Figure 14A:
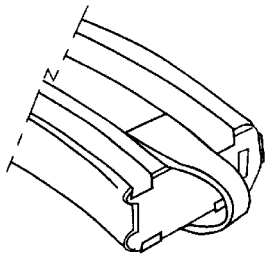
Figure 15:
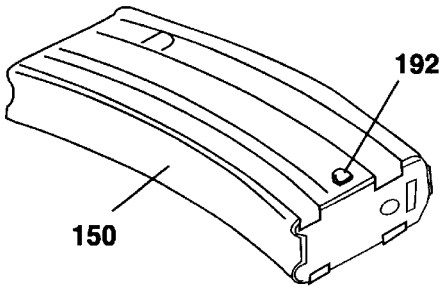
FIG. 15 is an exploded view of the invention using anchoring nodes on the magazine.
Figure 15A:
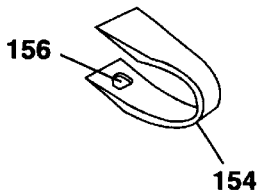
FIG. 15*a* is a perspective view of the invention in FIG. 15 assembled
Figure 15A:
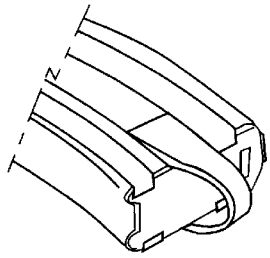
Figure 16:
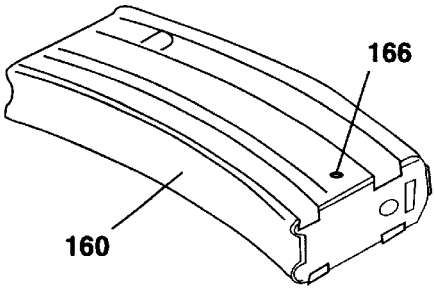
FIG. 16 is an exploded view of the invention using rivets to fasten the handle to the magazine.
Figure 16A:
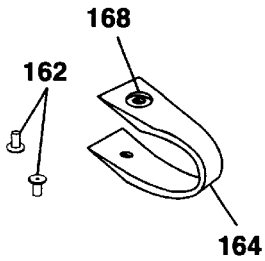
FIG. 16*a* is a perspective view of the invention in FIG. 16 assembled.
Figure 16A:
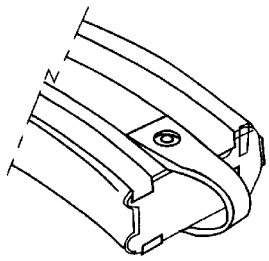

In the third embodiment, shown in FIGS. 13 and 14, at least one wall 132 of a plastic ammunition magazine 130 is extended above the level of the floor plate 138. The extension 134 may be molded into whatever shape a user desires, including extending a plurality of sides and molding them together in some fashion, such as a loop 136 in FIG. 13. A handle may be added to the magazine in a number of different methods. Referring to FIG. 15, the magazine may be molded with an anchor point 152 and a separate handle 154 may be either molded onto the anchor directly or may be ultrasonically welded onto the magazine 150. Handle 154, if molded separately, may have molded notch 156 to interface with the anchor point 152. A handle may also be attached mechanically to a non-plastic magazine, such as by the rivets 162 show in FIG. 16 or by an adhesive anchoring base 142 in FIG. 14. In FIG. 14, the improvement is the use of the handle 144, which is superior to parachute cord and may be molded in any fashion disclosed above, along with-broad adhesive bases 142, with a temporary adhesive backing 144. Unlike the "para-cord loops" the handle does not move relative to the magazine, allowing for the entire range of benefits of use of the handles with a lower cost than other handle embodiments. In either the second or third embodiments, the shapes and forms of any handle structure may follow as those described in the first embodiment, though loops would be preferred for more permanent attachments as they would easily allow access to floor plates.

Although the present invention has been described with reference to preferred embodiments, numerous modifications and variations can be made and still the result will come within the scope of the invention. No limitation with respect to the specific embodiments disclosed herein is intended or should be inferred.

I claim:

1. In combination with a prior art ammunition magazine, an extraction extension comprising:

a substitute floor plate, having obverse and reverse sides, and of identical dimensions and configuration as a floor plate for the ammunition magazine, designed to mechanically associate with said magazine; and a handle, further comprising a tab measuring between 1.0 and 1.5 inches in height, molded together in one piece with the substitute floor plate, protruding from the obverse side of the floor plate, having a plurality of hollows fashioned along the handle, the hollows defining interior regions which are roughened to increase friction and an end of the handle furthest from the floor plate defined as the top of the handle;

wherein, the substitute floor plate to be installed so that the reverse side of the substitute floor plate provides a bottom surface for a follower spring in the magazine.

2. The extraction extension of claim 1, wherein the handle shape is selected from the set of shapes consisting of: a flat polygonal shape, a wedge, an ellipsoidal shape, a cylinder, and a rectangular solid.

3. The extraction extension of claim 1, wherein a hole, suitable for attachment purposes, is fashioned in the handle.

4. The extraction extension of claim 3, wherein the handle shape is selected from the set of shapes consisting of: a flat polygonal shape, a wedge, an ellipsoidal shape, a cylinder, and a rectangular solid.

5. In combination with a prior art ammunition magazine, an extraction extension comprising:

a substitute floor plate, having obverse and reverse sides, and of identical dimensions and configuration as a floor plate for the ammunition magazine, designed to mechanically associate with said magazine; and a handle, further comprising a tab with a grip and a fastening end, molded with at least one anchoring means on the fastening end and a corresponding number of at least one anchoring hole, positioned and sized to receive said handle's anchoring means, are manufactured in the substitute floor plate, the handle also further comprising a plurality of hollows fashioned along the handle, the hollows defining interior regions which are roughened to increase friction;

wherein the handle and substitute floor plate are coupled by the anchoring means being forced through the at least one hole of the substitute floor plate from the obverse side and secured on the reverse side of the substitute floor plate, the handle then protruding from the substitute floor plate and the substitute floor plate is installed so that the reverse side of the floor plate provides a bottom surface for a follower spring in the magazine.

6. The extraction extension of claim 5, wherein the handle height measures 1.0 to 1.5 inches.

7. The extraction extension of claim 6, wherein the handle shape is selected from the set of shapes consisting of: a flat polygonal shape, a wedge, an ellipsoidal shape, a cylinder, and a rectangular solid.

8. The extraction extension of claim 6, wherein a hole, suitable for attachment purposes, is fashioned in the handle.

9. The extraction extension of claim 8, wherein the handle shape is selected from the set of shapes consisting of: a flat polygonal shape, a wedge, an ellipsoidal shape, a cylinder, and a rectangular solid.

* * * * *